US006868985B2

(12) United States Patent
Mori et al.

(10) Patent No.: US 6,868,985 B2
(45) Date of Patent: Mar. 22, 2005

(54) SMALL-SIZED VENDING MACHINE

(75) Inventors: Kichihei Mori, Tokyo (JP); Yasuhiro Ota, Tokyo (JP)

(73) Assignee: Mars Incorporated, McLean, VA (US)

( * ) Notice: Subject to any disclaimer, the term of this patent is extended or adjusted under 35 U.S.C. 154(b) by 0 days.

(21) Appl. No.: 10/314,125

(22) Filed: Dec. 9, 2002

(65) Prior Publication Data

US 2004/0026446 A1 Feb. 12, 2004

Related U.S. Application Data

(63) Continuation of application No. PCT/JP01/04888, filed on Jun. 11, 2001.

(30) Foreign Application Priority Data

Jun. 9, 2000 (JP) ..... 2000-174112

(51) Int. Cl.[7] ..... B65H 1/08
(52) U.S. Cl. ..... 221/232; 221/281
(58) Field of Search ..... 221/282, 283, 221/232, 268, 279, 272, 123, 131

(56) References Cited

U.S. PATENT DOCUMENTS 3,172,713 A 3/1965 Rupert
3,640,427 A * 2/1972 House ..... 221/127
5,975,349 A * 11/1999 Menes ..... 221/232

FOREIGN PATENT DOCUMENTS

JP 7029058 1/1995
JP 272103 10/1995

* cited by examiner

*Primary Examiner*—Kenneth Noland
(74) *Attorney, Agent, or Firm*—Fitzpatrick, Cella, Harper & Scinto

(57) ABSTRACT

A small-sized automatic vending machine for snack confectionery is provided, which is capable of being fitted to a side surface of an already installed automatic vending machine for drinks, or the like, and which enables machine size reduction, commodity protection, and a first-in first-out operation for commodities. The small-sized automatic vending machine comprises a base frame (4), which is capable of being fitted to a mounting surface (2), and a cabinet (6). The cabinet (6) comprises a commodity vending opening (10), which is located at an upper region, and a commodity accommodating section, which is located within the cabinet (6) and accommodates a plurality of commodities (CA, CB) laid-up on commodity carriers (26A, 26B). A lower region of the cabinet (6) is pivotably supported on the base frame (4) via a hinge (8), such that the cabinet (6) is capable of being set in a sideways fallen state, in which the commodity accommodating section is exposed. In the sideways fallen state, commodity replenishment is performed by leaving the commodities, which remain in the commodity accommodating section, at a predetermined position, and moving the commodity carriers (26A, 26B) in a direction heading away from the commodity vending opening (10).

10 Claims, 8 Drawing Sheets

SMALL-SIZED VENDING MACHINE

This application is a continuation of International Application No. PCT/JP01/04888, filed Jun. 11, 2001, designating the United States of America and which claims priority to JP2000-174112, filed Jun. 9, 2000.

TECHNICAL FIELD

This invention relates to a small-sized automatic vending machine. This invention particularly relates to a small-sized automatic vending machine, which is capable of being fitted to a side surface of an already installed automatic vending machine for drinks, or the like.

BACKGROUND ART

Stand-alone types of automatic vending machines, which accommodate commodities and vend the accommodated commodities automatically, have heretofore been used widely. Ordinarily, as the stand-alone types of automatic vending machines, automatic vending machines for vending drinks, such as canned juices and canned coffees, are popular. A large number of such automatic vending machines are installed at various sites on roads and in indoor facilities, such as station yards and movie theaters.

Also, recently, besides the stand-alone types of automatic vending machines for drinks, stand-alone types of automatic vending machines, from which foods for light meals are capable of being purchased easily, such as automatic vending machines for ice creams and automatic vending machines for snack confectionery, are installed at various sites.

When drinks are purchased, it is often desired that snack confectionery is capable of being purchased together with the drinks. Therefore, it will be desirable as forms of installation of automatic vending machines that the automatic vending machines for snack confectionery are installed together with the automatic vending machines for drinks. It is considered that, if the automatic vending machines for snack confectionery are installed together with the automatic vending machines for drinks, sales of both the drinks and the snack confectionery will be enhanced, and serviceability will also be enhanced.

In cases where the automatic vending machines for snack confectionery are to be installed together with the automatic vending machines for drinks, it will be most efficient and desirable that the automatic vending machines for snack confectionery are installed by the side of the automatic vending machines for drinks, which have already been installed. However, a space for installation of the stand-alone types of automatic vending machines for snack confectionery will not always be available in the vicinity of the stand-alone types of automatic vending machines for drinks, which have already been installed. Also, in order for the automatic vending machines for snack confectionery to be installed, considerable labor and time and a high cost are required. It is considered that the problems described above are typical reasons why the automatic vending machines for snack confectionery do not become popular.

Also, ordinary automatic vending machines for drinks are constituted such that a commodity taking-out opening (i.e., a commodity vending opening) is formed at a lower region of the automatic vending machine, and the lowest commodity, which is among a plurality of commodities laid up within a commodity accommodating section formed at an upper region of the automatic vending machine, is caused to fall into the commodity taking-out opening. In this manner, a first-in first-out operation for the commodities is facilitated. However, in cases where the commodity taking-out opening is formed at the lower region of the automatic vending machine, a space for exclusive use as the commodity taking-out opening becomes necessary, and therefore the size of the automatic vending machine cannot be kept small. Further, unlike the cases of the canned drinks, in cases where the commodities are the snack confectionery, there is the risk that the snack confectionery commodities will break due to the falling. Therefore, the falling type of commodity taking-out operation is not appropriate for the snack confectionery commodities. Accordingly, it may be considered that the commodity vending opening be formed at an upper region of the automatic vending machine. However, it is necessary for foods, including drinks, to be vended such that old foods are vended first. In cases where the commodity vending opening is formed at an upper region of the automatic vending machine, the first-in first-out operation for the commodities cannot always be performed.

In view of the above circumstances, the object of the present invention is to provide a small-sized automatic vending machine, wherein a commodity vending opening is formed at an upper region of the automatic vending machine, such that machine size reduction and commodity protection are capable of being achieved, and a first-in first-out operation for commodities is capable of being performed easily.

DISCLOSURE OF INVENTION

The present invention provides a first small-sized automatic vending machine capable of being fitted onto a mounting surface (such as a side surface of an already installed automatic vending machine), the automatic vending machine comprising:

i) a base frame, which is capable of being fitted onto the mounting surface, and ii) a cabinet, whose lower region is pivotably supported on the base frame.

Besides the side surface of the already installed automatic vending machine, the mounting surface for the first small-sized automatic vending machine in accordance with the present invention may be a wall surface of a building. The fitting of the first small-sized automatic vending machine in accordance with the present invention to the mounting surface may be performed with one of various known techniques. For example, holes may be perforated through the side surface of the already installed automatic vending machine, and the small-sized automatic vending machine in accordance with the present invention may be secured with screws, or the like, to the side surface of the already installed automatic vending machine. Alternatively, the first small-sized automatic vending machine in accordance with the present invention may be secured to the side surface of the already installed automatic vending machine by use of suction cups, which stick firmly to the side surface with, for example, lever operations. In any case, for prevention of crimes, it is necessary that securing sections are located at positions which cannot be accessed from the exterior during ordinary use. For example, the first small-sized automatic vending machine in accordance with the present invention should preferably be constituted such that the cabinet is covered with a cover member provided with a lock as will be described later, and the fitting sections are located at positions which cannot be seen from the exterior and cannot be touched from the exterior in a state in which the cabinet has been covered with the cover member provided with the lock.

In the first small-sized automatic vending machine in accordance with the present invention, the cabinet is capable of undergoing a pivoting movement between an upright state, in which the cabinet is latched onto the base frame, such that a commodity vending opening of the cabinet is located at an upper position, and such that the cabinet accommodates a plurality of commodities laid-up on a commodity carrier located for vertical movement within the cabinet, and a sideways fallen state, in which a commodity accommodating section that accommodates the plurality of the commodities is capable of being exposed, and commodity replenishment into the commodity accommodating section is capable of being performed in the sideways fallen state of the cabinet with an operation, in which the commodity carrier is moved in a direction heading away from the commodity vending opening, while certain commodities remaining within the commodity accommodating section are being left at a predetermined position in the commodity accommodating section.

The first small-sized automatic vending machine in accordance with the present invention should preferably be modified such that commodity pushing-up means and commodity delivering means are located within the cabinet, the commodity pushing-up means successively performing pushing-up operations for pushing up the plurality of the laid-up commodities in the upright state of the cabinet in a manner such that, with each of the successive pushing-up operations, the commodity pushing-up means lifts the commodity carrier by a distance equal to a height of each of the laid-up commodities, the commodity delivering means delivering the highest commodity on the commodity carrier into the commodity vending opening.

In the cases of the most simple constitution, only one commodity carrier may be located within the cabinet, and the commodities of an identical kind may be laid-up on the commodity carrier. Alternatively, the first small-sized automatic vending machine in accordance with the present invention may be modified such that a plurality of commodity carriers are located so as to stand side by side with in the cabinet, and a plurality of commodity delivering means are located such that each of the commodity delivering means corresponds to one of the commodity carriers.

The commodities of an identical kind may be laid-up on all of the plurality of the commodity carriers located so as to stand side by side within the cabinet. Alternatively, the kind of the commodities maybe altered for each of the commodity carriers.

As another alternative, the first small-sized automatic vending machine in accordance with the present invention may be modified such that only one commodity carrier is located within the cabinet, the commodities of an identical kind are laid-up in a plurality of columns on the commodity carrier, and a plurality of commodity delivering means are located such that each of the commodity delivering means corresponds to one of the columns of the laid-up commodities.

The cabinet described above should preferably be capable of being locked at the closed position. For example, the first small-sized automatic vending machine may be modified such that the automatic vending machine further comprises locking means, which is capable of locking the cabinet in the upright state and which, with an unlocking operation, allows the cabinet to shift into the sideways fallen state.

Also, the first small-sized automatic vending machine should preferably be modified such that, in cases where the commodities on the commodity carrier have been sold out, the commodity carrier is returned to the lowest position as an operation accompanying the unlocking operation of the locking means or the shifting of the cabinet into the sideways fallen state.

Further, the first small-sized automatic vending machine should preferably be modified such that the automatic vending machine further comprises a shutter, which ordinarily blocks the commodity vending opening, and which opens the commodity vending opening before the highest commodity is delivered by the commodity delivering means into the commodity vending opening.

The present invention also provides a second small-sized automatic vending machine capable of being fitted onto a mounting surface (such as a side surface of an already installed automatic vending machine), the automatic vending machine comprising:

i) a base frame, which is capable of being fitted onto the mounting surface, and ii) a cabinet secured to the base frame in an upright state, in which a commodity vending opening of the cabinet is located at an upper position, the cabinet accommodating a plurality of commodities laid-up on a commodity carrier located for vertical movement within the cabinet, wherein commodity pushing-up means and commodity delivering means are located within the cabinet, the commodity pushing-up means successively performing pushing-up operations for pushing up the plurality of the laid-up commodities in the upright state of the cabinet in a manner such that, with each of the successive pushing-up operations, the commodity pushing-up means lifts the commodity carrier by a distance equal to a height of each of the laid-up commodities, the commodity delivering means delivering the highest commodity on the commodity carrier into the commodity vending opening.

The second small-sized automatic vending machine in accordance with the present invention should preferably be modified such that a plurality of commodity carriers are located so as to stand side by side within the cabinet, and a plurality of commodity delivering means are located such that each of the commodity delivering means corresponds to one of the commodity carriers.

Alternatively, in the second small-sized automatic vending machine in accordance with the present invention, only one commodity carrier may be located within the cabinet. Also, the second small-sized automatic vending machine in accordance with the present invention may be provided with a shutter for blocking the commodity vending opening.

With each of the first and second small-sized automatic vending machines in accordance with the present invention, various effects described below are capable of being obtained.

Specifically, each of the first and second small-sized automatic vending machines in accordance with the present invention, which are provided with the base frame capable of being fitted to the mounting surface, is capable of being fitted to a wide variety of large-sized automatic vending machines regardless of whether the large-sized automatic vending machines are newly installed automatic vending machines or already installed automatic vending machines and regardless of the types of the large-sized automatic vending machines.

Also, acquisition of the site for installation is one of the most important problems for the automatic vending machine business. With each of the first and second small-sized automatic vending machines in accordance with the present invention, an already existing site is capable of being utilized for the installation, the acquisition of the site for installation becomes markedly easy.

Further, with each of the first and second small-sized automatic vending machines in accordance with the present invention, vending of commodities of different categories, commodities relevant to one another, and commodities (premiums) for sales promotion becomes possible with one automatic vending machine.

Furthermore, in cases where each of the first and second small-sized automatic vending machines in accordance with the present invention is attached to a large-sized automatic vending machine, a constitution, wherein the large-sized automatic vending machine is taken as a main machine, and a controller, a coin mechanism, a cooling device, and the like, of the main machine are utilized also for the small-sized automatic vending machine, is capable of being achieved. As a result, reasonable specification setting becomes possible, and there is a possibility of size reduction and low cost being achieved.

Also, with the first small-sized automatic vending machine in accordance with the present invention, the cabinet is capable of undergoing the pivoting movement between the commodity vending waiting position in the upright state and the commodity loading position in the sideways fallen state, in which the commodity accommodating section is capable of being exposed. Further, the commodity replenishment into the commodity accommodating section is capable of being performed in the sideways fallen state of the cabinet with the operation, in which the commodity carrier is moved in the direction heading away from the commodity vending opening, while certain commodities remaining within the commodity accommodating section are being left at the predetermined position in the commodity accommodating section. Therefore, a first-in first-out operation for the commodities is capable of being performed, and maintenance work for the automatic vending machine is easy to perform.

Further, in cases where the commodity vending opening is formed at a lower region of an automatic vending machine as in the conventional automatic vending machines, the commodities are caused to fall down into the commodity vending opening, and therefore there is the risk that the commodities are broken. However, with each of the first and second small-sized automatic vending machines in accordance with the present invention, wherein the commodity vending opening is formed at an upper region of the cabinet, there is no risk of the commodities being broken. Also, the commodities are capable of being taken out easily. Further, a space for exclusive use as the commodity vending opening, which space is necessary in cases where the commodity vending opening is formed at the lower region of the automatic vending machine, becomes unnecessary, and therefore the size of the automatic vending machine is capable of being kept small.

With the first small-sized automatic vending machine in accordance with the present invention, wherein the automatic vending machine further comprises the locking means, which is capable of locking the cabinet in the upright state and which, with the unlocking operation, allows the cabinet to shift into the sideways fallen state, the problems with regard to robbery, and the like, are capable of being eliminated, and the automatic vending machine is capable of being installed safely.

The first in accordance with the present invention small-sized automatic vending machine may be modified such that, in cases where the commodities on the commodity carrier have been sold out, the commodity carrier is returned to the lowest position as the operation accompanying the unlocking operation of the locking means or the shifting of the cabinet into the sideways fallen state. With the modification described above, the commodity loading into the commodity accommodating section is capable of being performed markedly easily.

With each of the first and second small-sized automatic vending machines in accordance with the present invention, wherein the commodity vending opening is provided with the shutter described above, the problems with regard to the entry of dust through the commodity vending opening and commodity robbery through the commodity vending opening are capable of being prevented from occurring. Also, in cases where the temperature within the cabinet is kept at a low temperature with a cooling device, low-temperature insulation effects are capable of being obtained.

BEST MODE OF CARRYING OUT THE INVENTION

Figure 1:
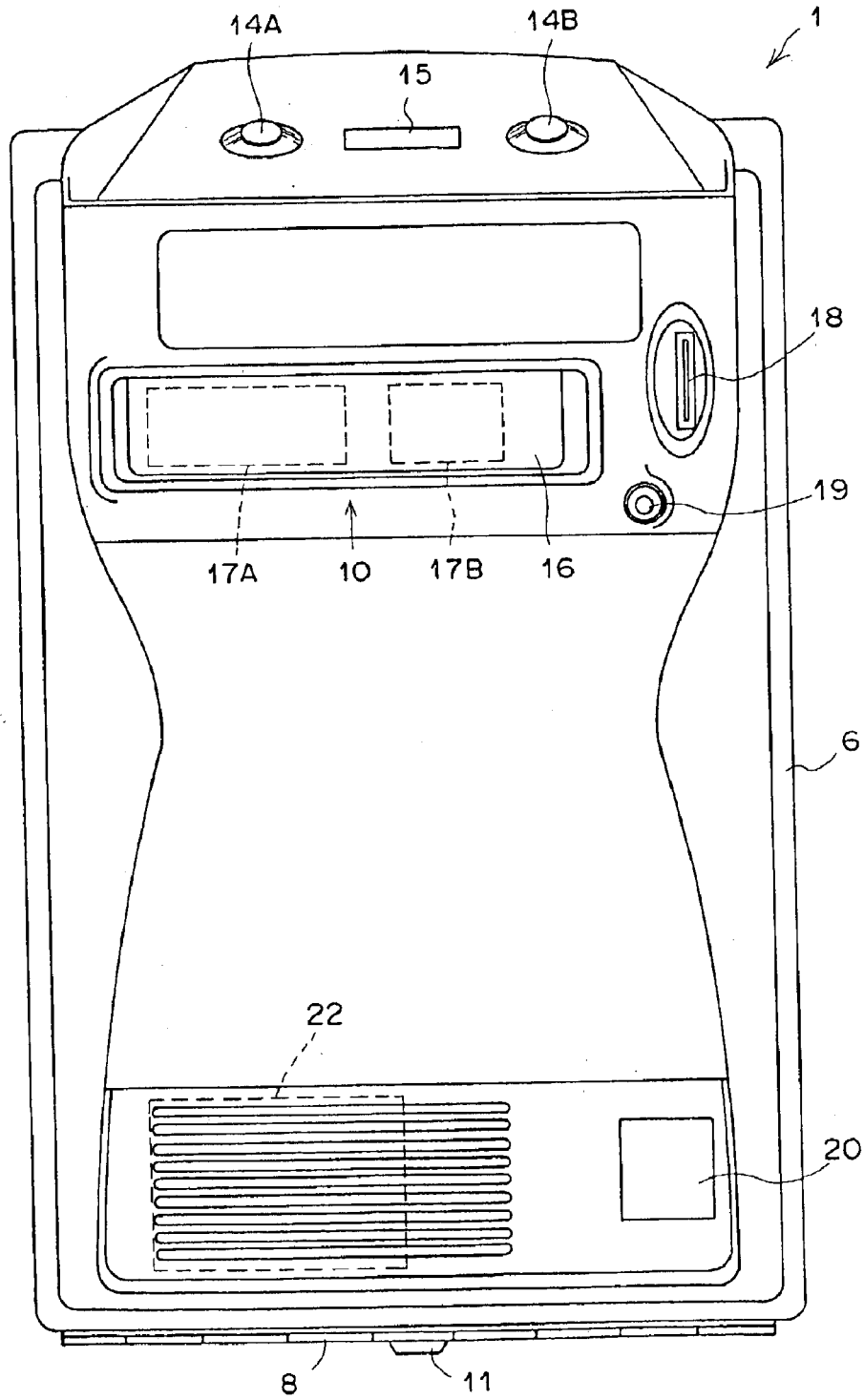
FIG. 1 is a schematic front view showing an embodiment of the small-sized automatic vending machine in accordance with the present invention.

The present invention will hereinbelow be described in further detail with reference to the accompanying drawings.

As illustrated in FIG. 1 to FIG. 4, a small-sized automatic vending machine 1 comprises a base frame 4 having an L-shaped side shape. The base frame 4 is constituted of a back plate 4*a* and a bottom plate 4*b*, which is bent forwardly by an angle of approximately 90 degrees from a lower end of the back plate 4*a*. The small-sized automatic vending machine 1 also comprises a cabinet 6, in which a commodity accommodating section and commodity conveying means are located. Outer surfaces of the cabinet 6 are covered with a cover member. The back plate 4*a* of the base frame 4 is capable of being fitted onto a mounting surface 2, which may be, for example, an outer side surface of an already installed large-sized automatic vending machine for drinks, a wall surface of a building, or a surface of a stand for exclusive use. Though not shown in FIG. 1 to FIG. 4 and not described herein in detail, the back plate 4*a* of the base frame 4 is provided with fitting means. Also, a reinforcing member (not shown) is fitted between the back plate 4*a* and the bottom plate 4*b*.

A lower region of the cabinet 6 is pivotably supported by a hinge 8, which extends horizontally at a front end of the bottom plate 4*b* of the base frame 4. The cabinet 6 is capable of undergoing a pivoting movement between an upright state (i.e., a commodity vending waiting state), in which the cabinet 6 is latched onto the base frame 4 with a commodity vending opening 10 of the cabinet 6 being located at an upper position as indicated by the solid line in FIG. 3, and a sideways fallen state (i.e., a commodity loading and maintenance check state), in which the cabinet 6 has been fallen forwardly by an angle of approximately 90 degrees around the hinge 8.

Figure 2:
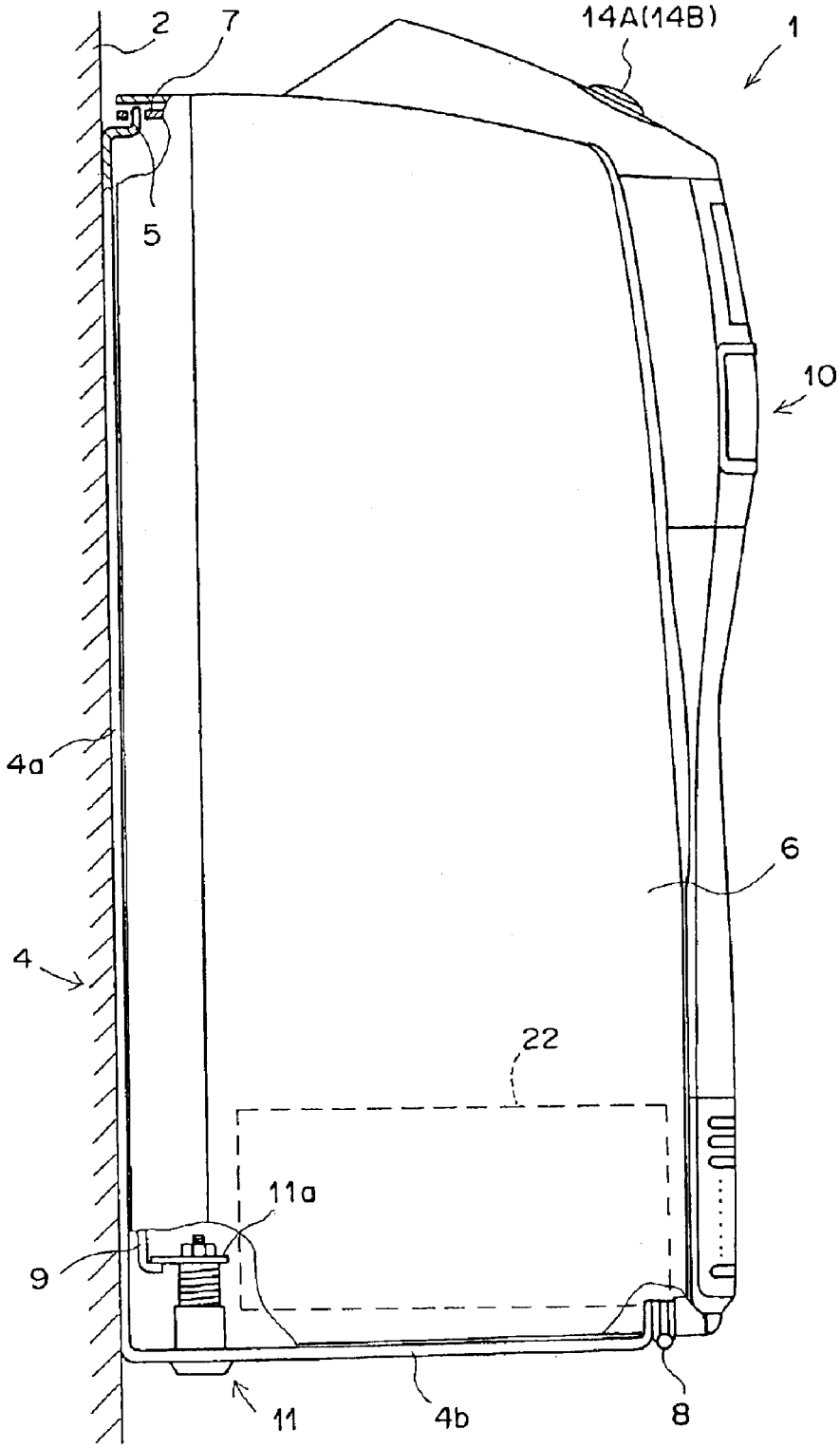
FIG. 2 is a partially cutaway, partially sectional side view showing the small-sized automatic vending machine of FIG. 1.
Figure 3:
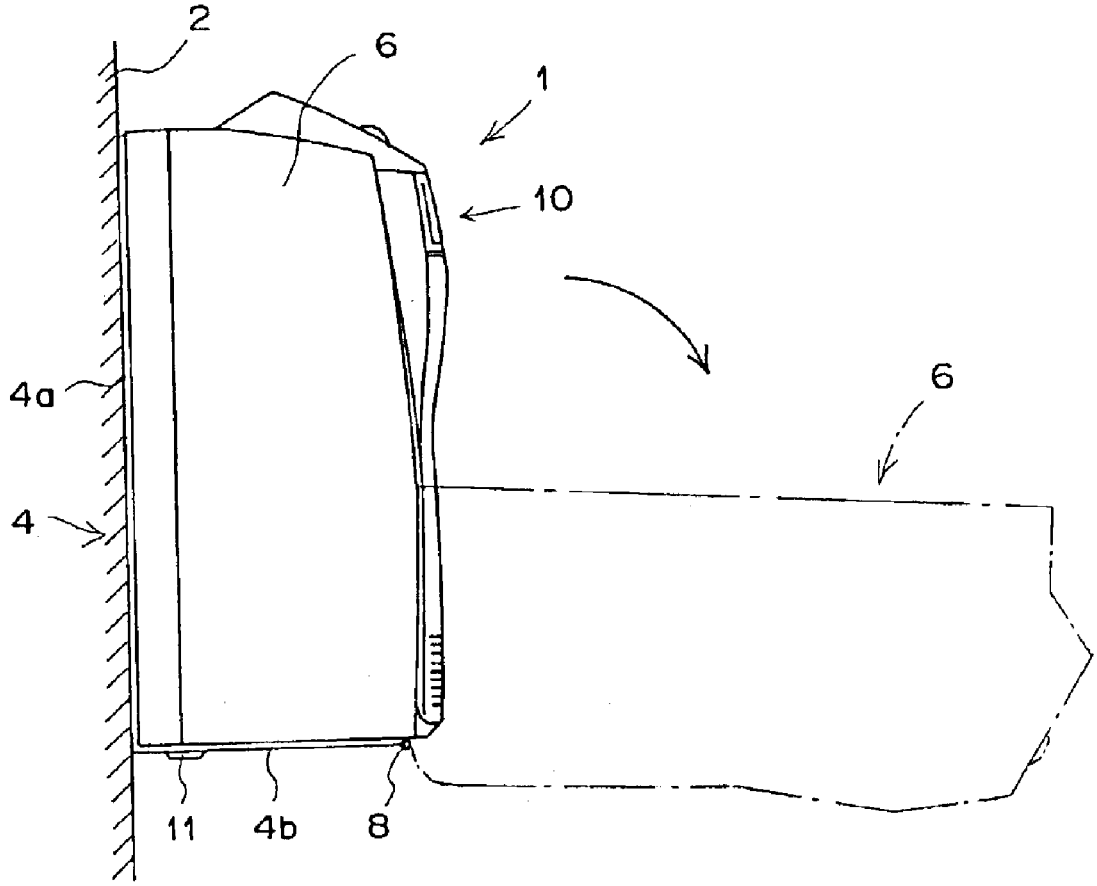
FIG. 3 is an explanatory side view showing a pivoting movement of a cabinet of the small-sized automatic vending machine of FIG. 1.
Figure 4:
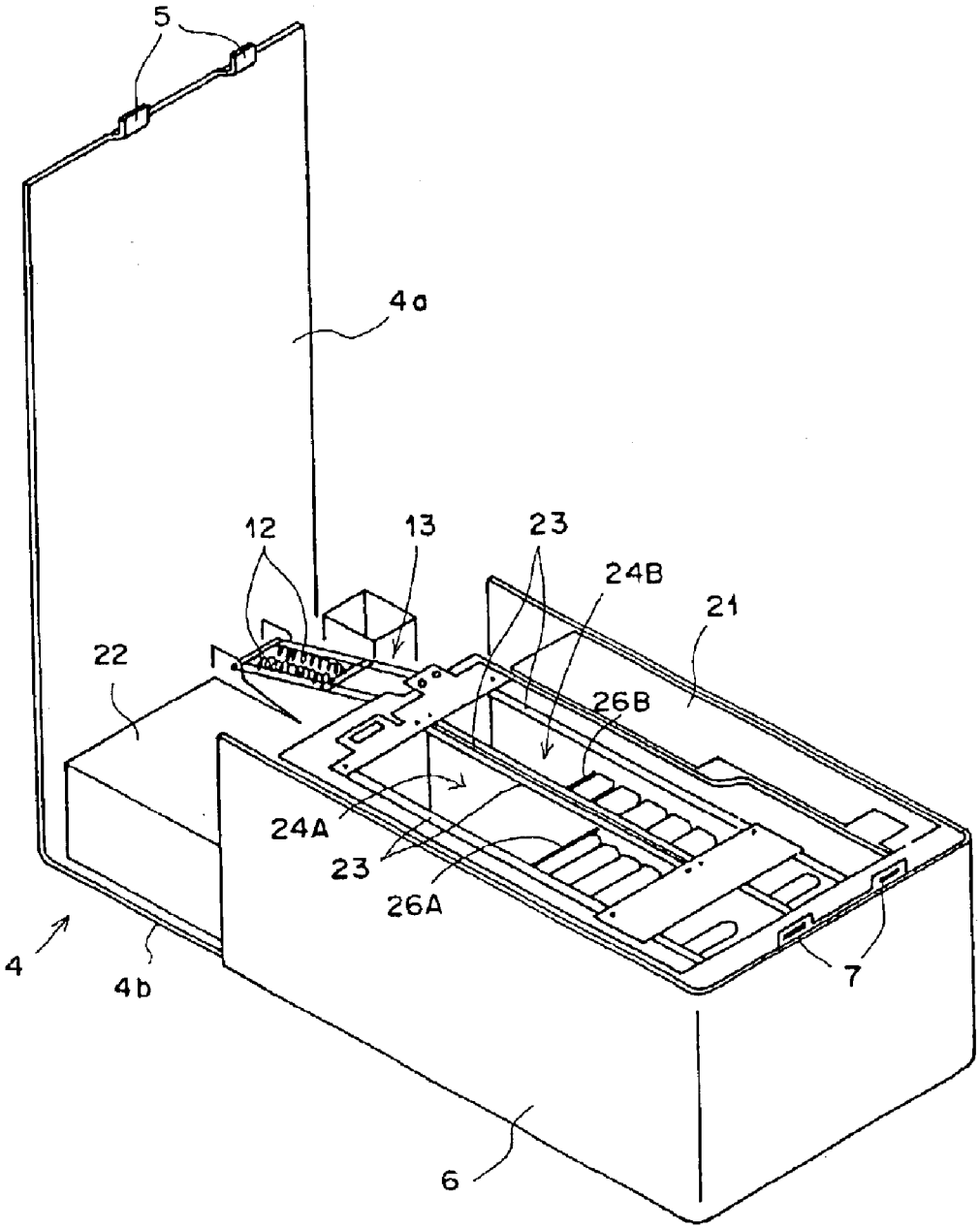
FIG. 4 is a perspective view showing the small-sized automatic vending machine of FIG. 1 in a state in which the cabinet has been set in a sideways fallen state, and a rear cover of the cabinet has been removed to expose a commodity accommodating section.

As illustrated in FIG. 2 and FIG. 4, cabinet latching pieces 5, 5, which stand facing up, are formed at an upper end of the back plate 4*a* of the base frame 4. Also, engagement pieces 7, 7, each of which has a slit, are formed at an upper end of a back surface of the cabinet 6. The cabinet latching pieces 5, 5 of the back plate 4*a* of the base frame 4 are inserted into the slits of the engagement pieces 7, 7 of the cabinet 6. In this manner, the cabinet 6 is latched in the upright state onto the base frame 4. Further, the cabinet 6 is locked in the upright state by a lock 11, which is located at a back end region of the bottom plate 4*b* of the base frame 4.

Specifically, in a locked state, a locking piece 11*a*, which is secured to a rotation shaft of the lock 11, engages with a hook 9 of the cabinet 6, and an upward movement of the cabinet 6 is thus obstructed. Therefore, in this state, the upper end of the cabinet 6 cannot be disengaged from the base frame 4. In cases where a key is inserted into the lock 11 from below, and the locking piece 11*a* is rotated to an unlocking position by the key, the cabinet 6 is unlocked. In this state, the cabinet 6 is capable of being raised slightly. As a result, the latching with the cabinet latching pieces 5, 5 is released, and the cabinet 6 is allowed to undergo the pivoting movement into the sideways fallen state shown in FIG. 4.

Also, the back plate 4*a* of the base frame 4 and a frame of the cabinet 6 are linked to each other by a folding type of linking mechanism 13 illustrated in FIG. 4, which is provided with two springs 12, 12. With the folding type of the linking mechanism 13, the cabinet 6 is supported in the sideways fallen state, in which the cabinet 6 has been fallen sideways by an angle of approximately 90 degrees.

Figure 5:
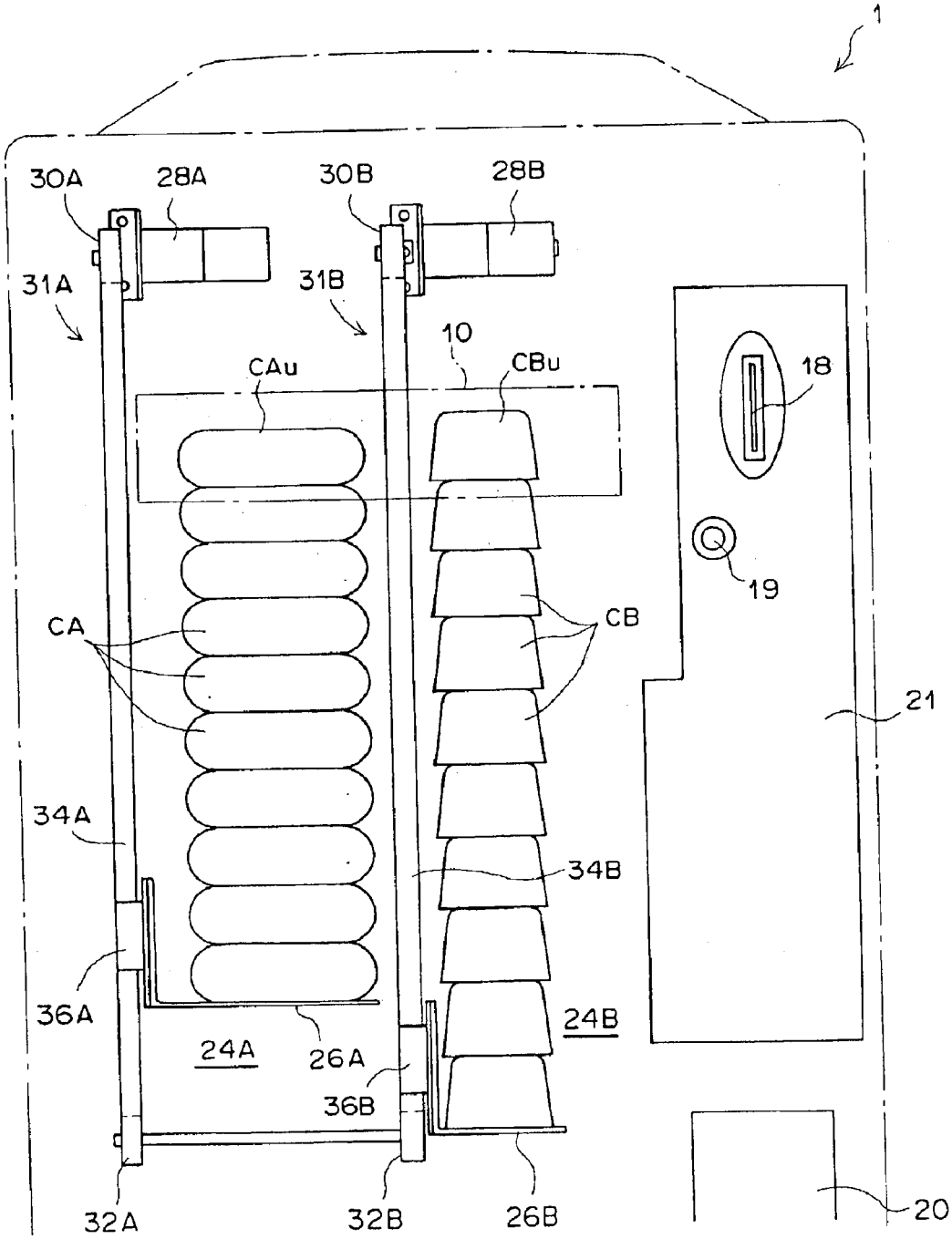
FIG. 5 is a schematic front view showing the commodity accommodating section and commodity conveying mechanisms located within the cabinet.
Figure 6:
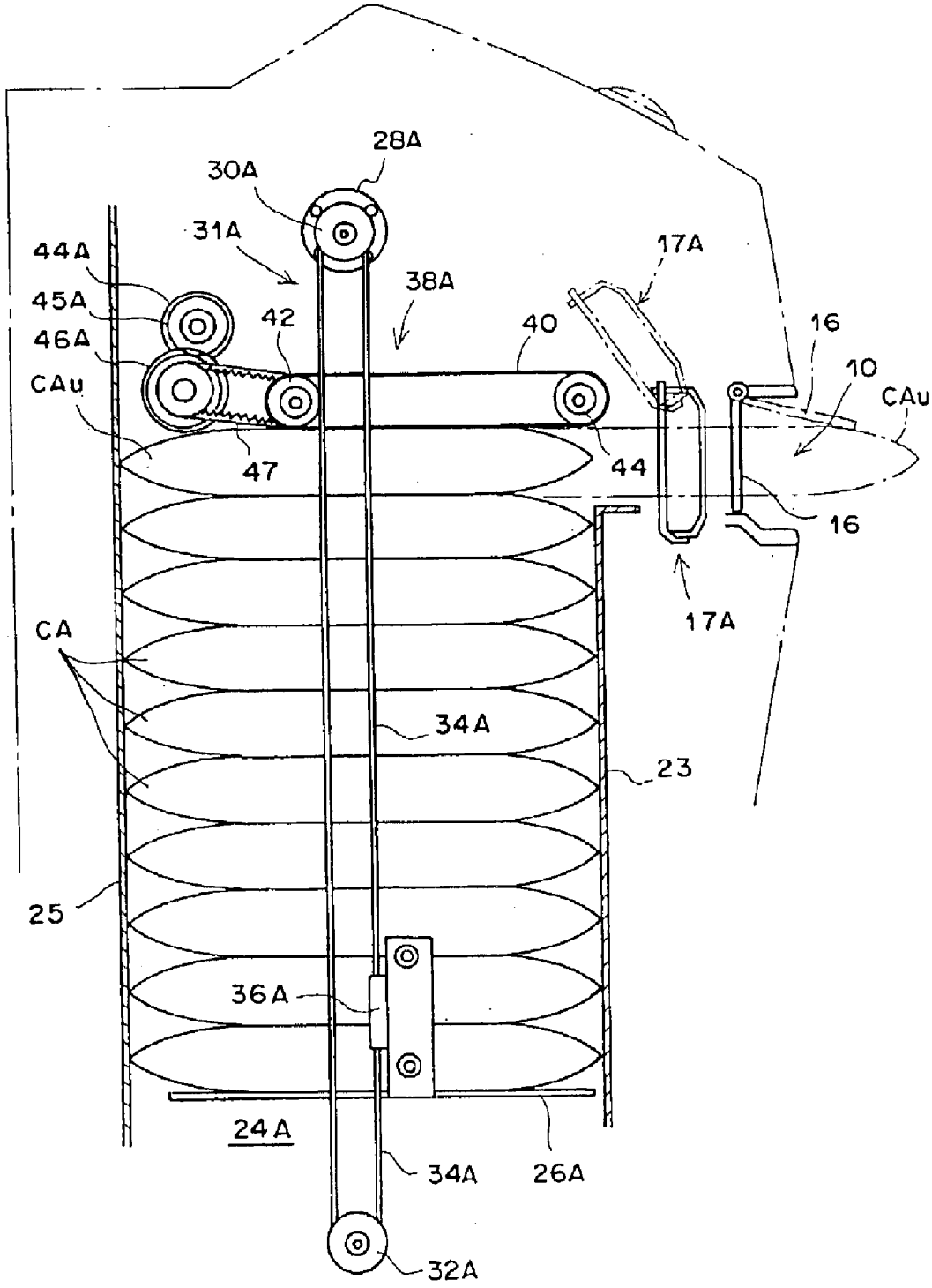
FIG. 6 is a schematic side view showing a commodity conveying mechanism, which is located on the left-hand side of FIG. 5.
Figure 7:
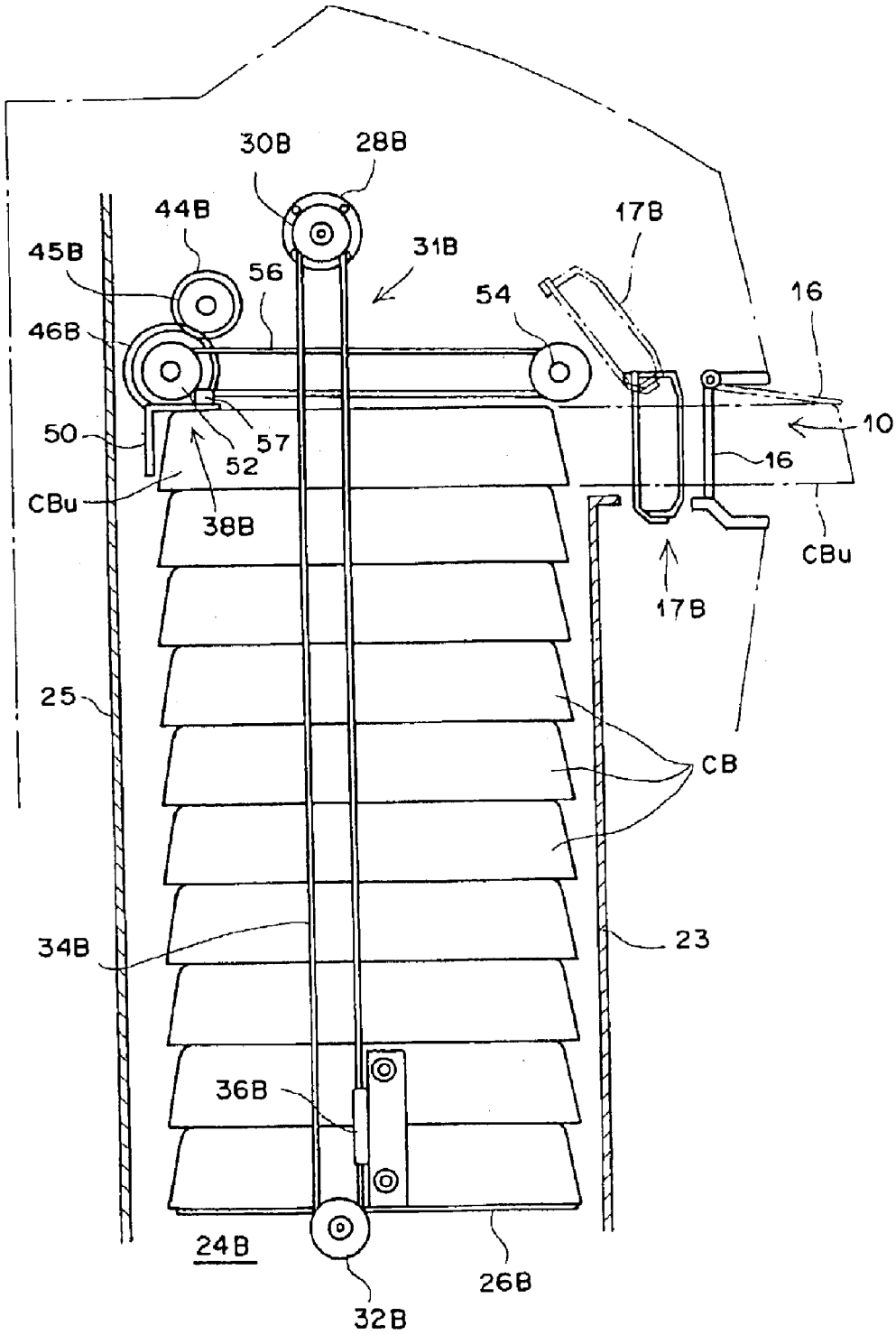
FIG. 7 is a schematic side view showing a commodity conveying mechanism, which is located on the right-hand side of FIG. 5.

Commodities which are vended with the small-sized automatic vending machine 1 include, for example, bagged confectionery commodities CA, CA, . . . , which have indefinite shapes and contain loose peanut-containing chocolate candies, as illustrated on the left-hand side of FIG. 5 and in FIG. 6, and packaged peanut-containing chocolate bar commodities CB, CB, . . . , which are comparatively hard and have definite shapes, as illustrated on the right-hand side of FIG. 5 and in FIG. 7. Hereinbelow, mechanisms and members associated with the commodities CA, CA, . . . will be numbered with reference numerals accompanied by A. Also, similar mechanisms and similar members associated with the commodities CB, CB, . . . will be numbered with reference numerals accompanied by B.

As illustrated in FIG. 1 and FIG. 2, commodity selecting push buttons 14A and 14B and a displaying section 15 are located at an oblique top surface of the small-sized automatic vending machine 1. Also, the commodity vending opening 10 is located at an upper region of a front surface of the small-sized automatic vending machine 1. The commodity vending opening 10 is provided with a door 16, which is locked at a closed position when vending is not to be performed. Further, a coin introducing opening 18 of a coin mechanism 21 is located along the side of the commodity vending opening 10. A coin returning push button 19 is located below the coin introducing opening 18. Furthermore, a coin returning opening 20 is located at a lower region of the front surface of the small-sized automatic vending machine 1.

Each of the commodity selecting push buttons 14A and 14B is provided with a selection indicating LED and a sold-out state indicating LED. In cases where the amount of money of the coin, which has been introduced through the coin introducing opening 18, has reached an amount of money, which has been set for the commodity vending, when the small-sized automatic vending machine 1 is in the venting waiting state, the selection indicating LED is turned on. In cases where the commodities have been sold out, the sold-out state indicating LED is turned on and displays "SOLD OUT." Also, a vending state indicating LED, which displays "VENDING" when being turned on, is built in the displaying section 15.

Further, a cooling device 22, which utilizes a Peltier device and cools the region inward from the cabinet 6, is secured to the bottom plate 4*b* of the base frame 4. A heat insulating material (not shown) is fitted to the frame of the cabinet 6 and a cabinet rear cover 25 of the cabinet 6, which rear cover will be described later. In this manner, the temperature of the commodity accommodating section of the cabinet 6 is kept at a predetermined temperature. This embodiment maybe modified such that the coin mechanism 21, the coin returning opening 20, and the like, are secured to the bottom plate 4*b* of the base frame 4 together with the cooling device 22.

As illustrated in FIG. 4, the commodity accommodating section of the cabinet 6 is partitioned by a plurality of column frames 23, 23, . . . , which extend vertically, into commodity accommodating columns 24A and 24B. As illustrated in FIG. 6 and FIG. 7, back sides of the commodity accommodating columns 24A and 24B are covered with the cabinet rear cover 25, which is capable of being removed easily and which is constituted of a heat insulating cover.

FIG. 5 is a schematic front view showing the commodity accommodating section and mechanisms (comprising commodity pushing-up means 31A and commodity pushing-up means 31B) for conveying the commodities CA, CA, . . . and the commodities CB, CB, . . . upwardly, the commodity accommodating section and the mechanisms being located within the cabinet 6. FIG. 6 is a schematic side view showing a commodity conveying mechanism for the commodities CA, CA, . . . (comprising the commodity pushing-up means 31A and commodity delivering means 38A). FIG. 7 is a schematic side view showing a commodity conveying mechanism for the commodities CB, CB, . . . (comprising the commodity pushing-up means 31B and commodity delivering means 38B). In FIG. 5, the column frames 23, 23, . . . are not shown.

A plate-shaped commodity carrier 26A, which has dimensions and a shape corresponding to the dimensions and the shapes of the commodities CA, CA, . . . , is located for vertical movement within the commodity accommodating column 24A. Also, a plate-shaped commodity carrier 26B, which has dimensions and a shape corresponding to the dimensions and the shapes of the commodities CB, CB, . . . , is located for vertical movement within the commodity accommodating column 24B. Ten pieces of the commodities CA, CA, . . . are laid up on the commodity carrier 26A, and ten pieces of the commodities CB, CB, . . . are laid up on the commodity carrier 26B. A driving motor 28A (a direct current geared motor) is located at an upper region of the commodity accommodating column 24A. Also, a driving motor 28B (a direct current geared motor) is located at an upper region of the commodity accommodating column 24B. An endless belt 34A is threaded over a driving pulley 30A, which is secured to a shaft of the driving motor 28A, and a driven pulley 32A, which is located at a lower region of the commodity accommodating column 24A. Also, an endless belt 34B is threaded over a driving pulley 30B, which is secured to a shaft of the driving motor 28B, and a driven pulley 32B, which is located at a lower region of the commodity accommodating column 24B. The commodity carrier 26A is connected to the endless belt 34A by a belt connector 36A. Also, the commodity carrier 26B is connected to the endless belt 34B by a belt connector 36B. In this manner, the commodity pushing-up means 31A for pushing up the commodities CA, CA, and the commodity pushing-up means 31B for pushing up the commodities CB, CB, . . . are constituted.

Further, as illustrated in FIG. 6, a commodity CAu, which is located at the highest position among the commodities CA, CA, . . . laid up on the commodity carrier 26A, is delivered by the commodity delivering means 38A, which has a constitution adapted to the commodity form of the commodities CA, CA, . . . , into the commodity vending opening 10. Also, as illustrated in FIG. 7, a commodity CBu, which is located at the highest position among the commodities CB, CB, . . . laid upon the commodity carrier 26B, is delivered by the commodity delivering means 38B, which has a constitution adapted to the commodity form of the commodities CB, CB, . . . , into the commodity vending opening 10.

Figure 8:
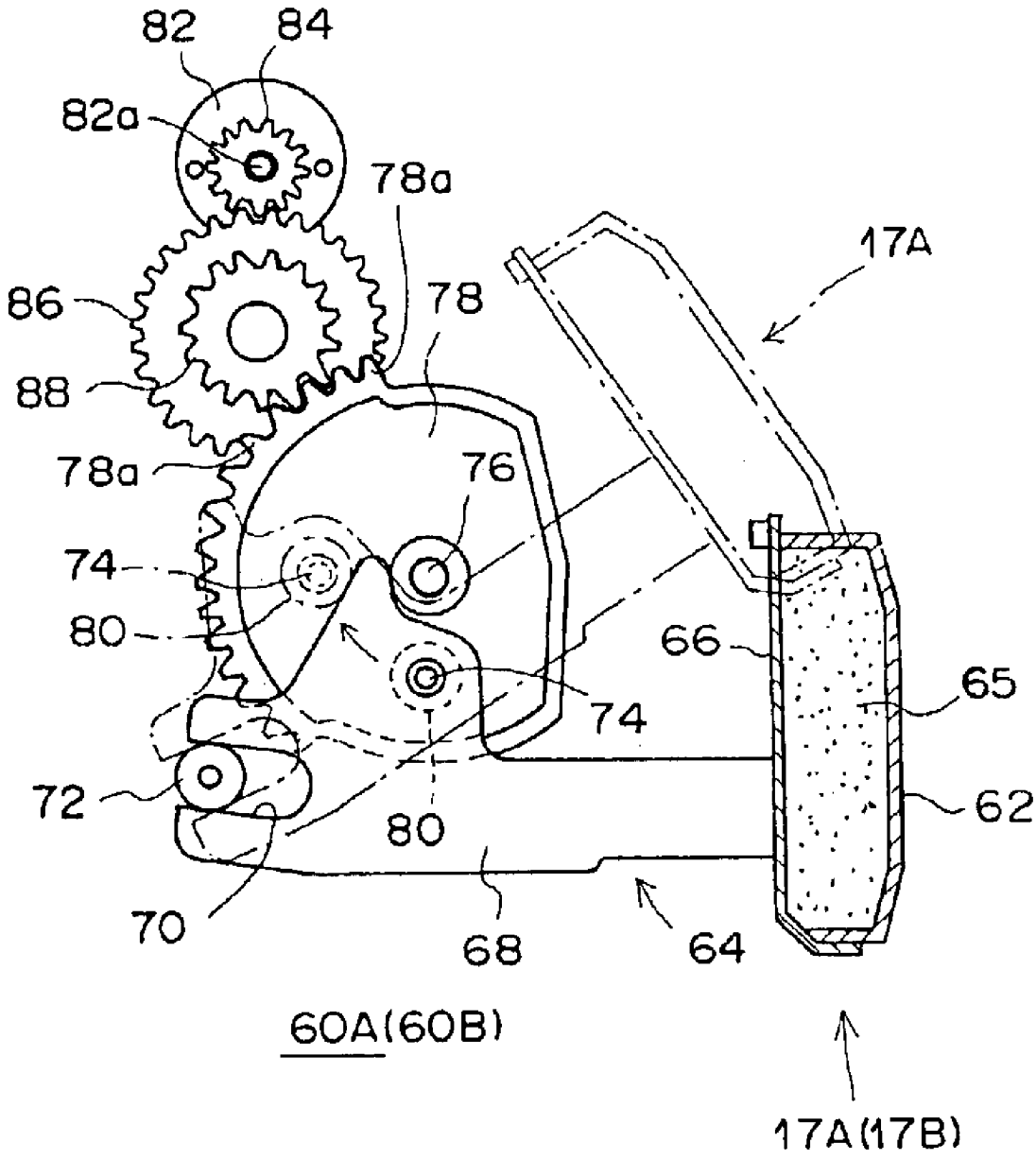
FIG. 8 is a side view showing a shutter driving mechanism.

As illustrated in FIG. 6, the commodity delivering means 38A is provided with two pressing types of endless conveyor belts 40, 40, which are comparatively wide and are located at a predetermined spacing from each other. The endless conveyor belts 40, 40 are brought into contact with the upper surface of the highest commodity CAu by being slightly pushed against the upper surface of the highest commodity CAu. A driving pulley 42 is located on the inner side (i.e., on the left-hand side in FIG. 6). Also, a driven pulley 44 is located on the side of the commodity vending opening 10. The driving pulley 42 and the driven pulley 44 are supported respectively on a left-hand end and a right-hand end of a trestle (not shown), which extends horizontally in FIG. 6. The endless conveyor belts 40, 40 are threaded over the driving pulley 42 and the driven pulley 44. The trestle for supporting the driving pulley 42 is slightly urged downwardly by springs (not shown). Further, the driving pulley 42 is rotated by a driving motor (a direct current geared motor) 44A via a gear 45A, a gear 46A, and a belt 47. As a result, the conveyor belts 40, 40 are rotated counterclockwise in FIG. 6 and deliver the highest commodity CAu toward the commodity vending opening 10. A low-temperature insulation shutter 17A is located on the side inward from the door 16 of the commodity vending opening 10. Normally, the low-temperature insulation shutter 17A blocks the commodity vending opening 10. Before the conveyor belts 40, 40 are driven, a shutter driving mechanism 60A illustrated in FIG. 8 is actuated to move the low-temperature insulation shutter 17A upwardly. In this manner, the commodity vending opening 10 is opened.

As illustrated in FIG. 7, the commodity delivering means 38B is provided with a conveying plate 50, which pushes the rear surface of the highest commodity CBu and delivers the commodity CBu toward the commodity vending opening 10. The conveying plate 50 is supported for sliding movement on a trestle (not shown), which extends horizontally in FIG. 7. A driving pulley 52 is located on the inner side (i.e., on the left-hand side in FIG. 7). Also, a driven pulley 54 is located on the side of the commodity vending opening 10. The driving pulley 52 and the driven pulley 54 are supported respectively on a left-hand end and a right-hand end of the trestle. An endless belt 56 is threaded over the driving pulley 52 and the driven pulley 54. The conveying plate 50 is connected by a belt connector 57 to the endless belt 56. Further, the driving pulley 52 is rotated by a driving motor (a direct current geared motor) 44B via a gear 45B and a gear 46B. As a result, the conveying plate 50 is moved toward the right-hand side in FIG. 7 and pushes the highest commodity CBu toward the commodity vending opening 10. A low-temperature insulation shutter 17B is located on the side inward from the door 16 of the commodity vending opening 10. Normally, the low-temperature insulation shutter 17B blocks the commodity vending opening 10. Before the conveying plate 50 is driven, a shutter driving mechanism 60B, which has a constitution similar to the constitution of the shutter driving mechanism 60A illustrated in FIG. 8, is actuated to move the low-temperature insulation shutter 17B upwardly. In this manner, the commodity vending opening 10 is opened.

FIG. 8 is a side view showing the shutter driving mechanism 60A and the shutter driving mechanism 60B. As illustrated in FIG. 8, each of the low-temperature insulation shutter 17A and the low-temperature insulation shutter 17B is provided with a plate-shaped shutter main body 62, whose upper and lower end regions are bent rearward, and a shutter frame 64, which supports the shutter main body 62. The low-temperature insulation shutter 17A and the low-temperature insulation shutter 17B have an approximately identical constitution, except that the widths of the shutter main body 62 and a support plate 66 of the low-temperature insulation shutter 17A are different from the widths of the shutter main body 62 and the support plate 66 of the low-temperature insulation shutter 17B.

The shutter frame 64 is provided with the support plate 66, which is formed at the front end of the shutter frame 64. The support plate 66 have dimensions approximately identical with the dimensions of the shutter main body 62. The support plate 66 supports the shutter main body 62, such that a space for accommodating a heat insulating material 65 is formed between the support plate 66 and the shutter main body 62. Also, the shutter frame 64 is provided with an arm section 68, which is bent approximately at a right angle from one side of the support plate 66 and extends rearward (i.e., toward the left-hand side in FIG. 8). A groove 70, which extends in the direction of extension of the arm section 68, is formed at a base end region of the arm section 68, and the base end region of the arm section 68 thus constitutes a forked region. A shaft 72 secured to the cabinet frame is engaged with the groove 70. Also, the arm section 68 is provided with a shaft-shaped cam follower 74, which extends from the back surface (i.e., the surface on the background side in FIG. 8) of the arm section 68 in the vicinity of the groove 70 at an angle normal to the plane of the sheet of FIG. 8.

Each of the shutter driving mechanism 60A and the shutter driving mechanism 60B is provided with a cam plate 78, which is capable of rotating around a shaft 76 having an axis normal to the plane of the sheet of FIG. 8. The cam plate 78 is provided with gear teeth 78*a*. The gear teeth 78*a* are formed at a certain area of the outer periphery of the cam plate 78, which outer periphery constitutes a circular arc having its center point at the shaft 76. Also, a circular cylinder-shaped body 80 is projected from the side surface of the cam plate 78 toward the foreground side in FIG. 8. The circular cylinder-shaped body 80 is located at a position spaced by a predetermined distance from the axis of the shaft 76. The circular cylinder-shaped body 80 has an axis parallel with the axis of the shaft 76. The cam follower 74 of the shutter frame 64 is loosely fitted into the center hole of the circular cylinder-shaped body 80. When each of the low-temperature insulation shutter 17A and the low-temperature insulation shutter 17B is located at the closing position indicated by the solid line in FIG. 8, the circular cylinder-shaped body 80 of the cam plate 78 is located directly below the shaft 76.

A driving motor (a direct current geared motor) 82 is located above the cam plate 78. The rotating force of a gear 84, which is secured to a shaft 82*a* of the driving motor 82, is transmitted to the cam plate 78 via a gear 86 and a gear 88 in order to rotate the cam plate 78. When the cam plate 78 is thus rotated by an angle of approximately 90 degrees clockwise in FIG. 8, the circular cylinder-shaped body 80, into which the cam follower 74 of the shutter frame 64 has been loosely fitted, is also displaced by an angle of approximately 90 degrees around the shaft 76 and is thus brought to the position on the left-hand side of the shaft 76. Also, at this time, the shutter frame 64 is rotated counter-clockwise by an angle of approximately 45 degrees around the shaft 72 secured to the cabinet frame, while the shutter frame 64 is sliding slightly with respect to the shaft 72. In this manner, as indicated by the single-dot chained line in FIG. 8, the low-temperature insulation shutter 17A is moved to the open position.

How the small-sized automatic vending machine 1 having the constitution described above operates will be briefly described hereinbelow.

(1) Coin Introduction (a) When electric power is turned on, initial setting is begun, and the vending state indicating LED blinks in the displaying section 15. When the initial setting has been finished, the vending state indicating LED changes from the blinking state into a turned-on state, and the small-sized automatic vending machine 1 is set in the vending waiting state.

(b) When a coin is introduced through the coin introducing opening 18 in the vending waiting state, and the amount of money of the coin, which has been introduced through the coin introducing opening 18, has reached the amount of money (e.g., 100 yen), which has been set for the commodity CA, the selection indicating LED of the commodity selecting push button 14A is turned on. Also, when the amount of money of the coin, which has been introduced through the coin introducing opening 18, has reached the amount of money (e.g., 120 yen), which has been set for the commodity CB, the selection indicating LED of the commodity selecting push button 14B is turned on, and the selection indicating LED of the commodity selecting push button 14A is turned off.

(2) Commodity Selection and Conveyance (a) It becomes possible to select the commodity of the commodity accommodating column corresponding to the commodity selecting push button, whose selection indicating LED has been turned on. When the commodity selecting push button, whose selection indicating LED has been turned on, is pushed, the selected commodity is conveyed by the commodity delivering means 38A or the commodity delivering means 38B into the commodity vending opening 10. When the conveyance of the selected commodity is finished, a buzzer sounds.

(b) The selection indicating LED of the commodity selecting push button blinks from when the commodity conveyance is being performed to when the small-sized automatic vending machine 1 is set in the next vending waiting state. The commodity pushing-up means 31A or the commodity pushing-up means 31B corresponding to the commodity accommodating column, whose commodity has been vended in the manner described above, lifts the commodity carrier 26A or the commodity carrier 26B corresponding to the commodity accommodating column by a distance equal to the height of each of the commodities laid-up in the commodity accommodating column. The small-sized automatic vending machine 1 returns to the vending waiting state, the selection indicating LED of the commodity selecting push button is turned off, and the buzzer sounds two times.

(3) Sold-Out State (a) In cases where the commodities of either one of the commodity accommodating column 24A and the commodity accommodating column 24B have been sold out, the sold-out state indicating LED of the corresponding commodity selecting push button 14A or 14B is turned on. Also, when the lock 11 is unlocked, the small-sized automatic vending machine 1 shifts into a serviceman mode, and the commodity carrier 26A or the commodity carrier 26B corresponding to the commodity accommodating column, whose commodities have been sold out, is automatically returned to the lowest position.

(b) In cases where the commodities of both the commodity accommodating column 24A and the commodity accommodating column 24B have been sold out, both the sold-out state indicating LED of the commodity selecting push button 14A and the sold-out state indicating LED of the commodity selecting push button 14B are turned on.

(4) Shifting into the Serviceman Mode

When the key is inserted into the key hole of the lock 11 of the bottom plate 4*b* of the base frame 4 and is turned in order to unlock the lock 11, the buzzer sounds two times. Also, the sold-out state indicating LEDs and the vending state indicating LED blink, and the small-sized automatic vending machine 1 shifts into the serviceman mode.

(5) Commodity Loading (a) The cabinet 6 is raised slightly, and the latching with the cabinet latching pieces 5, 5 is thereby released. The cabinet 6 is then fallen sideways.

(b) The cabinet rear cover 25 is removed. In cases where the commodity carrier 26A and/or the commodity carrier 26B has not been moved to the lowest position, the commodity selecting push button 14A or 14B corresponding to the commodity accommodating column, which is associated with the commodity carrier to be moved, is pushed, and the commodity carrier is thus moved to the lowest position.

(c) The loading of the commodities is performed. In cases where several pieces of the commodities remain in the commodity accommodating column, the remaining commodities are left at a predetermined position, and new commodities are loaded into the empty region of the commodity accommodating column, which empty region is located on the side of the commodity carrier, i.e. the region which is located on the side under the remaining commodities (the under side, as viewed in cases where the cabinet 6 is in the upright state).

(d) When the commodity loading is finished, the commodity selecting push button 14A or 14B corresponding to the commodity accommodating column, into which the commodities have thus been loaded, is pushed, and the corresponding commodity carrier is raised to the predetermined position.

(6) Restoration Into the Vending Mode (a) The cabinet rear cover 25 is fitted to the cabinet 6. The cabinet 6 is held and raised, and the slits of the engagement pieces 7, 7 of the cabinet 6 are fitted onto the cabinet latching pieces 5, 5 of the base frame 4.

(b) The key having been inserted into the key hole of the lock 11 is turned to the original position.

(c) The buzzer sounds, and initial setting operations are performed.

As clear from the foregoing, the small-sized automatic vending machine 1, which is provided with the base frame 4 capable of being fitted to the mounting surface 2, is capable of being fitted to a wide variety of large-sized automatic vending machines regardless of whether the large-sized automatic vending machines are newly installed automatic vending machines or already installed automatic vending machines and regardless of the types of the large-sized automatic vending machines. Also, the small-sized automatic vending machine 1 is capable of being fitted to a stand for exclusive use, or the like.

Also, with the small-sized automatic vending machine 1, the lower region of the cabinet 6 is pivotably supported on the bottom plate 4*b* of the base frame 4 via the hinge 8. The cabinet 6 is capable of undergoing the pivoting movement between the position for commodity vending in the upright state and the position for commodity loading in the sideways fallen state, in which the commodity accommodating column 24A and the commodity accommodating column 24B are exposed as illustrated in FIG. 4. Further, in the sideways fallen state, commodity replenishment is capable of being performed by leaving the commodities, which remain in the commodity accommodating column 24A and/or the commodity accommodating column 24B, at the predetermined position, and moving the commodity carrier 26A and/or the commodity carrier 26B to the lowest position. Therefore, the first-in first-out operation for the commodities is capable of being performed easily. Also, the maintenance work is easy to perform.

Further, with the small-sized automatic vending machine 1, wherein the commodity vending opening 10 is formed at the upper region of the cabinet 6, the commodities are capable of being taken out easily. Further, a space for exclusive use as the commodity vending opening, which space is necessary in cases where the commodity vending opening is formed at the lower region of the automatic vending machine, becomes unnecessary, and therefore the size of the automatic vending machine 1 is capable of being kept small. Furthermore, since the commodity vending opening 10 is formed at the upper region of the cabinet 6, there is no risk that the commodities are broken as in the cases where the commodity vending opening is located at a lower region.

Also, the small-sized automatic vending machine 1 is provided with the lock 11, which is capable of locking the cabinet 6 in the upright state and which, with the unlocking operation, allows the cabinet 6 to shift into the sideways fallen state. Therefore, the problems with regard to robbery, and the like, are capable of being eliminated, and the small-sized automatic vending machine 1 is capable of being installed safely. Also, since the lock 11 is located at the bottom plate 4*b* of the base frame 4, the external appearance of the cabinet 6 is not affected adversely, and mischief cannot easily be played with the cabinet 6.

Further, the small-sized automatic vending machine 1 is provided with the low-temperature insulation shutter 17A and the low-temperature insulation shutter 17B, which ordinarily block the commodity vending opening 10. Before the highest commodity CAu is delivered by the commodity delivering means 38A into the commodity vending opening 10, the low-temperature insulation shutter 17A opens the commodity vending opening 10. Also, before the highest commodity CBu is delivered by the commodity delivering means 38B into the commodity vending opening 10, the low-temperature insulation shutter 17B opens the commodity vending opening 10. Therefore, the low-temperature insulation effect within the cabinet 6 is capable of being enhanced, and the problems with regard to the entry of dust through the commodity vending opening 10 and commodity robbery through the commodity vending opening 10 are capable of being prevented from occurring.

In the embodiment described above, the small-sized automatic vending machine 1 is provided with the commodity accommodating column 24A and the commodity accommodating column 24B, which respectively accommodate the commodities CA, CA, . . . and the commodities CB, CB, . . . which are of different kinds. Alternatively, a small-sized automatic vending machine may be constituted, which is provided with three commodity accommodating columns accommodating different kinds of commodities. As another alternative, a small-sized automatic vending machine may be constituted, wherein commodities of an identical kind are loaded into all of a plurality of commodity accommodating columns.

As a further alternative, a single common commodity carrier, i.e. single common commodity pushing-up means, is located with respect to a plurality of commodity accommodating columns, into which the commodities of an identical kind are loaded, and a plurality of commodity delivering means are located, each of which commodity delivering means is associated with one of the commodity accommodating columns. In such cases, the highest commodities in the commodity accommodating columns may be successively vended. Also, at the time at which the heights of the commodity stacks in the commodity accommodating columns become equal to one another, the single common commodity pushing-up means may be actuated.

Further, in the embodiment described above, the commodity delivering means 38A comprises the conveyor belts 40, 40, which are brought into contact with the upper surface of the highest commodity CAu by being slightly pushed against the upper surface of the highest commodity CAu. Also, the commodity delivering means 38B comprises the conveying plate 50, which pushes the highest commodity CBu toward the commodity vending opening 10. Alternatively, the commodity delivering means may be selected from other types of appropriate means in accordance with the forms of the commodities. For example, pressing types of conveying rollers maybe utilized as the commodity delivering means.

What is claimed is:

1. A small-sized automatic vending machine capable of being fitted onto a mounting surface, the automatic vending machine comprising:

i) a base frame, which is capable of being fitted onto the mounting surface, and ii) a cabinet, whose lower region is pivotably supported on the base frame, wherein the cabinet is capable of undergoing a pivoting movement between an upright state, in which the cabinet is latched onto the base frame, such that a commodity vending opening of the cabinet is located at an upper position, and such that the cabinet accommodates a plurality of commodities laid-up on a commodity carrier located for vertical movement within the cabinet, and a sideways fallen state, in which a commodity accommodating section that accommodates the plurality of the commodities is capable of being exposed, and commodity replenishment into the commodity accommodating section is capable of being performed in the sideways fallen state of the cabinet with an operation, in which the commodity carrier is moved in a direction heading away from the commodity vending opening, while certain commodities remaining within the commodity accommodating section are being left at a predetermined position in the commodity accommodating section.

2. A small-sized automatic vending machine as defined in claim 1 wherein commodity pushing-up means and commodity delivering means are located within the cabinet, the commodity pushing-up means successively performing pushing-up operations for pushing up the plurality of the laid-up commodities in the upright state of the cabinet in a manner such that, with each of the successive pushing-up operations, the commodity pushing-up means lifts the commodity carrier by a distance equal to a height of each of the laid-up commodities;

the commodity delivering means delivering the highest commodity on the commodity carrier into the commodity vending opening.

3. A small-sized automatic vending machine as defined in claim 2 wherein a plurality of commodity carriers are located so as to stand side by side within the cabinet, and a plurality of commodity delivering means are located such that each of the commodity delivering means corresponds to one of the commodity carriers.

4. A small-sized automatic vending machine as defined in claim 2 wherein only one commodity carrier is located within the cabinet, the commodities of an identical kind are laid-up in a plurality of columns on the commodity carrier, and a plurality of commodity delivering means are located such that each of the commodity delivering means corresponds to one of the columns of the laid-up commodities.

5. A small-sized automatic vending machine as defined in claim 1 wherein the automatic vending machine further comprises locking means, which is capable of locking the cabinet in the upright state and which, with an unlocking operation, allows the cabinet to shift into the sideways fallen state.

6. A small-sized automatic vending machine as defined in claim 5 wherein, in cases where the commodities on the commodity carrier have been sold out, the commodity carrier is returned to the lowest position as an operation accompanying the unlocking operation of the locking means or the shifting of the cabinet into the sideways fallen state.

7. A small-sized automatic vending machine as defined in claim 2 wherein the automatic vending machine further comprises a shutter, which ordinarily blocks the commodity vending opening, and which opens the commodity vending opening before the highest commodity is delivered by the commodity delivering means into the commodity vending opening.

8. A small-sized automatic vending machine capable of being fitted onto a mounting surface, the automatic vending machine comprising:

i) a base frame, which is capable of being fitted onto the mounting surface, and ii) a cabinet secured to the base frame in an upright state, in which a commodity vending opening of the cabinet is located at an upper position, the cabinet accommodating a plurality of commodities laid-up on a commodity carrier located for vertical movement within the cabinet, wherein commodity pushing-up means and commodity delivering means are located within the cabinet, the commodity pushing-up means successively performing pushing-up operations for pushing up the plurality of the laid-up commodities in the upright state of the cabinet in a manner such that, with each of the successive pushing-up operations, the commodity pushing-up means lifts the commodity carrier by a distance equal to a height of each of the laid-up commodities, the commodity delivering means delivering the highest commodity on the commodity carrier into the commodity vending opening.

9. A small-sized automatic vending machine as defined in claim 8 wherein a plurality of commodity carriers are located so as to stand side by side within the cabinet, and a plurality of commodity delivering means are located such that each of the commodity delivering means corresponds to one of the commodity carriers.

10. A small-sized automatic vending machine as defined in claim 8 wherein the automatic vending machine further comprises a shutter, which ordinarily blocks the commodity vending opening, and which opens the commodity vending opening before the highest commodity is delivered by the commodity delivering means into the commodity vending opening.

* * * * *

UNITED STATES PATENT AND TRADEMARK OFFICE

CERTIFICATE OF CORRECTION

PATENT NO. : 6,868,985 B2
DATED : March 22, 2005
INVENTOR(S) : Kichihei Mori et al.

It is certified that error appears in the above-identified patent and that said Letters Patent is hereby corrected as shown below:

Title page,
Item [56], References Cited, FOREIGN PATENT DOCUMENTS,
"7029058" should read -- 7-029058 --.

Column 3,
Line 41, "with in" should read -- within --.

Column 8,
Line 23, "venting" should read -- vending --; and
Line 37, "maybe" should read -- may be --.

Column 9,
Line 25, "CA, CA," should read -- CA, CA, … --.

Column 12,
Line 67, "i.e." should read -- i.e., --.

Column 14,
Line 37, "i.e." should read -- i.e., --.

Signed and Sealed this

Twenty-first Day of February, 2006

JON W. DUDAS
*Director of the United States Patent and Trademark Office*